US007938465B2

(12) United States Patent
Spacone et al.

(10) Patent No.: US 7,938,465 B2
(45) Date of Patent: May 10, 2011

(54) GOLF BALL RETRIEVER

(75) Inventors: Mary T. Spacone, Orlando, FL (US); Merry Riehm-Constantino, Buffalo, NY (US)

(73) Assignee: Qwikpik Golf LLC, Orlando, FL (US)

( * ) Notice: Subject to any disclaimer, the term of this patent is extended or adjusted under 35 U.S.C. 154(b) by 26 days.

(21) Appl. No.: 12/029,039

(22) Filed: Feb. 11, 2008

(65) Prior Publication Data

US 2008/0191503 A1 Aug. 14, 2008

Related U.S. Application Data

(60) Provisional application No. 60/889,159, filed on Feb. 9, 2007, provisional application No. 60/971,002, filed on Sep. 10, 2007.

(51) Int. Cl.
*A63B 47/02* (2006.01)

(52) U.S. Cl. ..... 294/19.2

(58) Field of Classification Search ..... 294/19.2, 294/55; 473/286; 56/332
See application file for complete search history.

(56) References Cited

U.S. PATENT DOCUMENTS

| | | | | |
|---|---|---|---|---|
| 651,222 | A * | 6/1900 | Wharton | 473/509 |
| 1,380,526 | A | 6/1921 | Carpenter | |
| 1,960,110 | A * | 5/1934 | Iles | 473/286 |
| 2,760,807 | A | 8/1956 | Watson | |
| 3,029,097 | A * | 4/1962 | Ward | 294/19.2 |
| 3,136,573 | A | 6/1964 | Harke | |
| 3,258,286 | A | 6/1966 | Coward | |
| 3,901,545 | A * | 8/1975 | Shott | 294/19.2 |
| 3,997,169 | A | 12/1976 | Bergstrom | |
| 4,073,529 | A * | 2/1978 | Ostrin | 294/19.2 |
| 4,313,632 | A | 2/1982 | King et al. | |
| 4,466,650 | A | 8/1984 | Roedel | |
| 4,678,108 | A | 7/1987 | Inman | |
| 4,819,938 | A | 4/1989 | Hill | |
| 4,949,961 | A | 8/1990 | Milano | |
| 4,951,947 | A | 8/1990 | Kopfle | |
| 4,968,079 | A | 11/1990 | Burton | |
| 5,205,598 | A | 4/1993 | Miller | |
| 5,310,177 | A | 5/1994 | Conrad et al. | |
| D360,918 | S | 8/1995 | Carlson | |
| 5,437,487 | A * | 8/1995 | Fulop | 294/19.2 |
| 5,460,366 | A | 10/1995 | Pugh | |
| 5,651,571 | A | 7/1997 | Diveto | |
| 5,672,121 | A | 9/1997 | Miller | |
| 5,755,632 | A | 5/1998 | Eddy | |

(Continued)

FOREIGN PATENT DOCUMENTS

JP 2006-223829 * 8/2006

*Primary Examiner* — Dean J Kramer
(74) *Attorney, Agent, or Firm* — Stephen B. Salai, Esq.; Michael J. Didas, Esq.; Harter Secrest & Emery LLP

(57) ABSTRACT

A ball retriever includes a basket and an elongate arm. The basket has a bottom, a sidewall, and an open top. The bottom of the basket has an aperture therethrough sized smaller than a ball to be retrieved. At least a portion of the bottom proximate the aperture is deformable to allow passage of the ball to be retrieved through the aperture when deformed and returning to the non-deformed position to retain the ball within the basket. The elongate arm is fixed to the basket at a first end.

11 Claims, 9 Drawing Sheets

U.S. PATENT DOCUMENTS

| | | | | |
|---|---|---|---|---|
| 5,921,598 | A | 7/1999 | Bredow | |
| 6,059,334 | A | 5/2000 | LaCourse et al. | |
| 6,120,387 | A | 9/2000 | Bobst | |
| 6,394,515 | B1 | 5/2002 | Keleher et al. | |
| 6,428,068 | B1 * | 8/2002 | Lavine | 294/19.2 |
| 6,572,167 | B2 | 6/2003 | Deininger | |
| D497,656 | S | 10/2004 | Maraschiello | |
| 6,824,179 | B1 | 11/2004 | Shelato | |
| 7,086,971 | B2 | 8/2006 | Zmetra | |
| 2006/0091681 | A1 | 5/2006 | Evilsizer | |
| 2006/0091682 | A1 | 5/2006 | Kerr | |

* cited by examiner

GOLF BALL RETRIEVER

BACKGROUND OF THE INVENTION

1. Field of the Invention

The present invention relates to a golf ball retriever. More specifically, the present invention relates to a golf ball retriever having multiple methods for retrieving a golf ball.

2. Description of Related Art

A number of devices are known for retrieving golf balls from water, woods, hazards, and the like.

However, there is a need in the art for a golf ball retriever that can be used while both in a seated position, e.g., when sitting in a riding golf cart, and in a standing position.

Many golfers, and non-golfers, participate in golf tournaments known as scrambles. As is known, these scrambles generally entail all golfers playing from the same position, that position being determined by the best shot amongst all shots from each of the golfers. For example, after each of four golfers in a team tees off, three of the balls must be retrieved and re-placed at the position of the best shot. Retrieving these three balls generally requires either getting out of the cart, bending over to pick up the ball, and returning to the cart, or extending your arm from the side of the moving cart, and grabbing the ball from the moving cart. The first alternative being overly laborious, and the second being unsafe.

Accordingly, there is a need in the art for an improved golf ball retriever that can be used to retrieve balls from a seated position in a moving golf cart and in a standing position from hazards such as water, brush, and the like.

BRIEF SUMMARY OF THE INVENTION

The present invention addresses the foregoing needs in the art by providing a ball retriever having an arm, a grip and a basket disposed at a distal end of the arm.

DETAILED DESCRIPTION OF THE PREFERRED EMBODIMENTS

Figure 1:
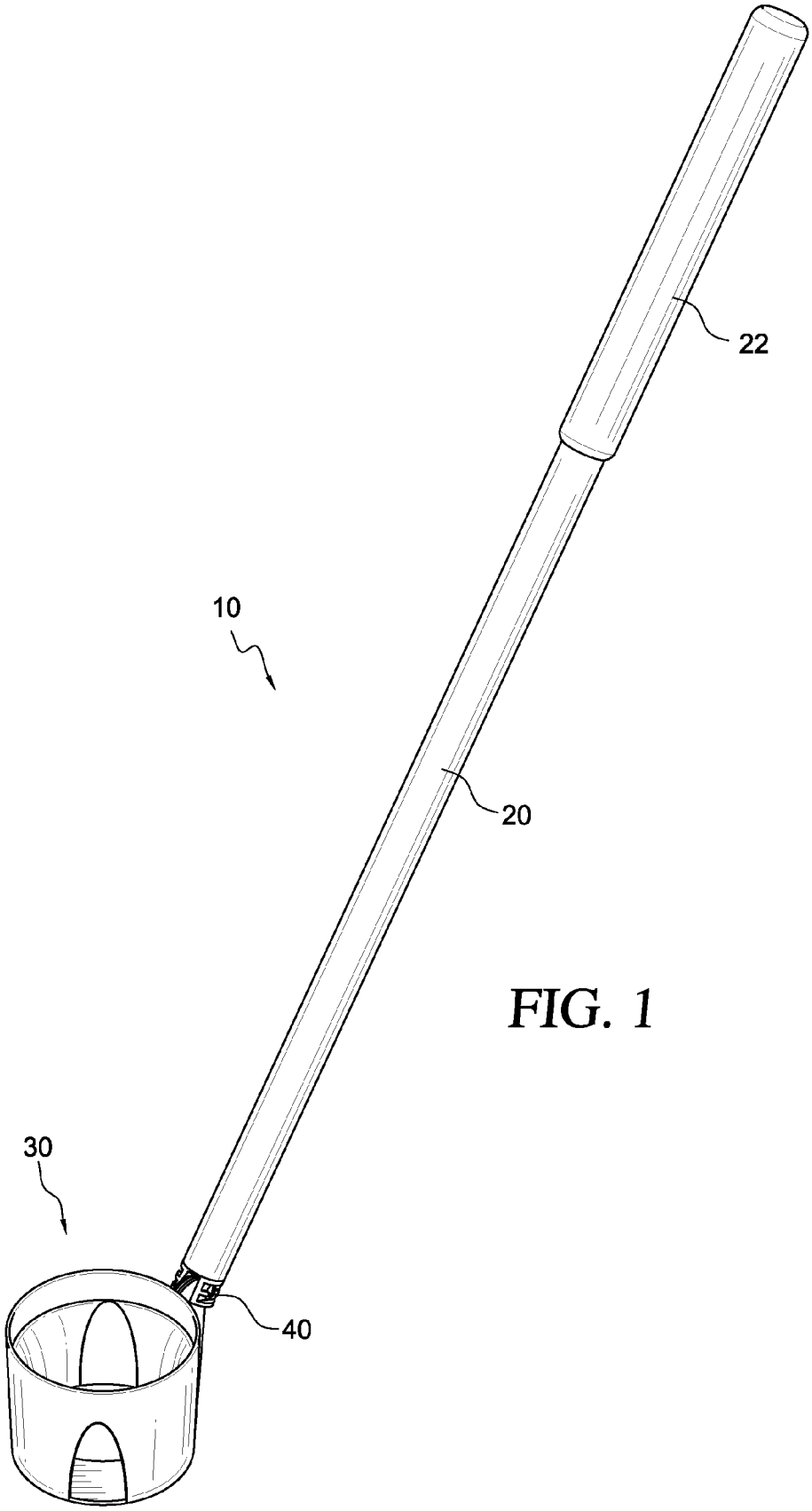
FIG. 1 is a perspective view of a golf ball retriever according to a first embodiment of the invention.

A golf ball retriever according to embodiments of the invention is illustrated in the figures. As shown therein, a golf ball retriever 10 generally includes an arm 20 and a basket 30 attached to the distal end of the arm 20. An attachment member 40 generally is provided to facilitate attachment of the arm 20 to the basket 30.

The arm 20 generally is cylindrical in shape and is made of a light-weight material, such as plastic. Of course, other materials, such as metals, woods, composite materials, and the like also may be used. The arm 20 preferably is on the order of from about 18 inches to about 36 inches and more preferably from about 26 inches to about 32 inches in length. Although the arm is shown as being a fixed length, the arm may be telescoping, as is generally known in the art. A telescoping arm generally may be extended to a length of from about 48 inches to about 240 inches in length, or more.

The grip 22 preferably is disposed for the comfort of the user. In particular, the grip 22 may be formed of a foam, or of some other rubber or leather material, such as may be conventionally used for grips on golf clubs. Alternatively or additionally, the grip may be molded for easier grasping by a user. In some embodiments, the grip may not be provided.

The basket 30 preferably includes a bottom 33 and a sidewall 31 depending upwardly therefrom and defining an open top 32. The basket may be any of a number of sizes and shapes, but preferably is sized to contain at least one, and more preferably between two and three golf balls therein.

Preferably, the sidewall 31 is of a minimal thickness, such that a golf ball may be readily "scooped" through the open top 32 into the basket 30. More specifically, it is desirable that the sidewall 31 be of a thickness that does not impede entrance of a golf ball 59 into the basket 30 through the open top and along the sidewall. The top of the sidewall also may be beveled or tapered to allow for easier entry of the golf ball into the basket, when scooped through the open top.

The bottom 33 of the basket 30 preferably has an aperture 34 formed therethrough. The illustrated aperture 34 has a generally round shape and diameter smaller than the diameter of the golf ball 59. In this manner, when a golf ball is scooped through the open top 32 of the basket 30, the golf ball will not fall through the bottom 33 of the basket 30.

A portion of the bottom 33 of the basket 30 preferably is flexible relative to the sidewall 31. More specifically, a portion of the bottom proximate to the aperture 34 preferably is flexible to allow entry of a golf ball through the bottom 33 of the basket 30. As illustrated in the figures, the bottom 33 may consist of a number of flaps 35 that are displaceable when a vertical force is applied thereto. Accordingly, the present invention provides a second method by which a golf ball may be retrieved.

When the basket 30 is set on top of a golf ball 59, a downward force on the basket 30 will cause the flaps 33 to displace upwardly, thereby effectively increasing the diameter of the aperture 34 formed through the bottom 33. With sufficient downward force, the golf ball 59 will pass by the flaps 35 and into the basket 30. Once into the basket 30, the flaps 35 will return to their normal, unflexed position and will retain the golf ball within the basket 30. As will be understood, the flaps 35 are substantially rigid that the weight of the golf ball will not deform the flaps, and thus a force greater than the weight of the golf ball will be required to retrieve the golf ball through the aperture 34.

Figure 3:
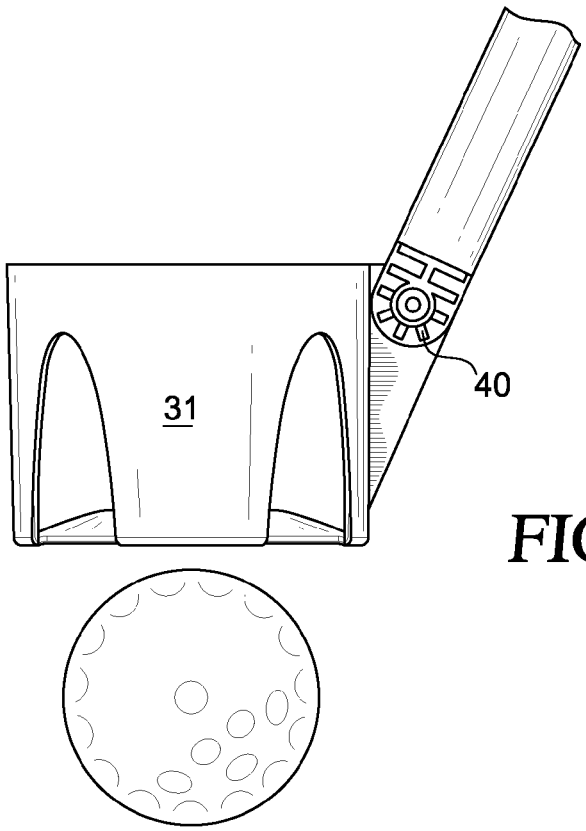
FIG. 3 is a side elevation view of the golf ball retriever illustrated in FIG. 1, showing a method of retrieving a golf ball according to a preferred embodiment of the invention.
Figure 4:
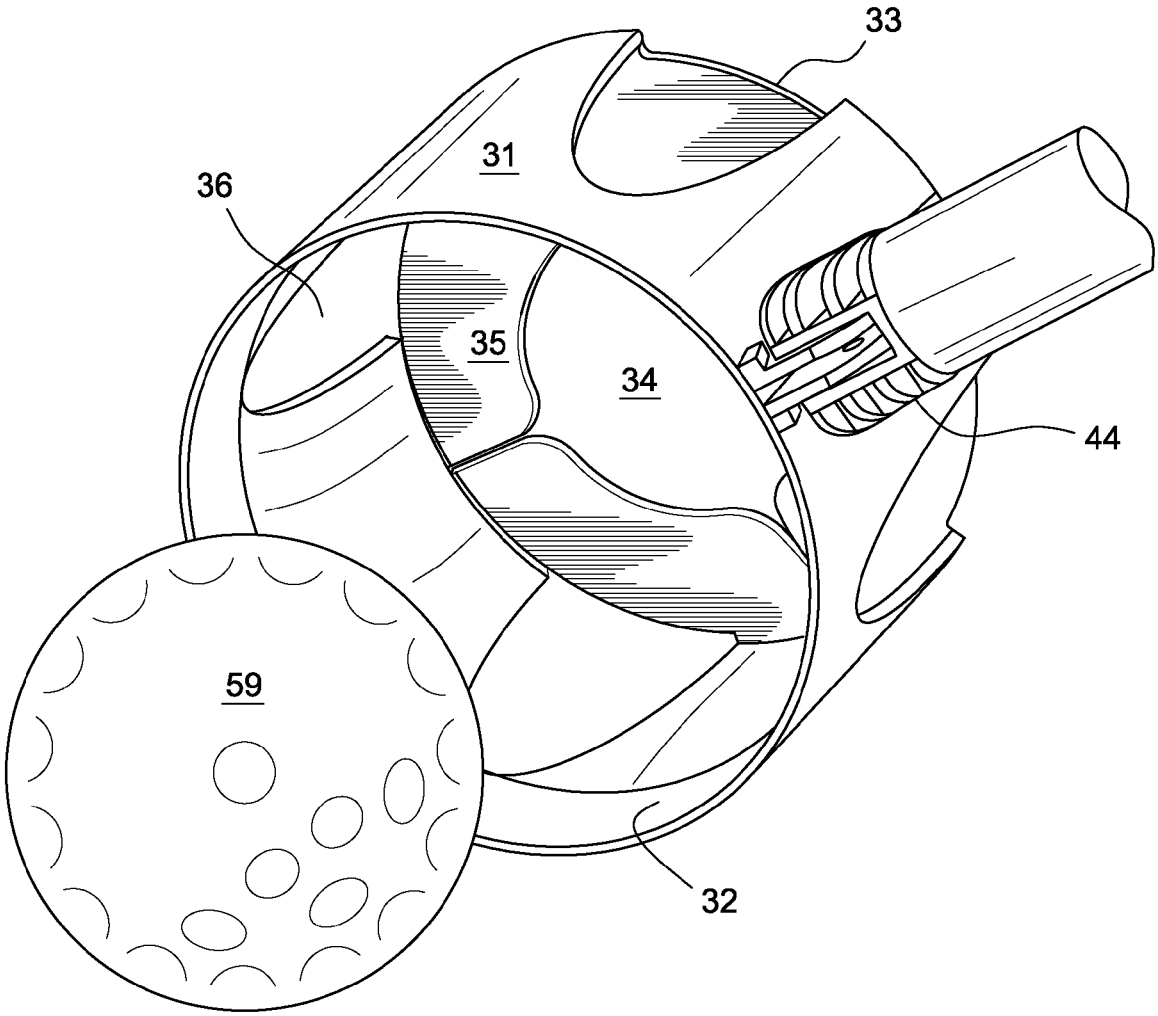
FIG. 4 is a perspective view of the golf ball retriever illustrated in FIG. 1, showing a method of retrieving a golf ball according to a preferred embodiment of the invention.

As illustrated, for example, in FIG. 3, the flaps 35 may, in the normal position, have a slight upward incline at distances away from the sidewall 31. In this manner, the flaps are more easily displaced upwardly, for example, when a ball is to be retrieved through the aperture 34, but the same flaps will provide a greater resistance to a ball 59 contained within the basket 30.

Although the figures depict four flaps 35, each comprising essentially 90° of the circular bottom 33, more or less flaps may be used. In addition, the flaps from each may be spaced from each other. For example, spacing the flaps from each may be effective to allow draining of the basket, e.g., when a ball is retrieved from wet or muddy conditions. In addition, one or more apertures 36 may be formed through the sidewall 31 to provide drainage of contents from within the basket 30. As should be readily appreciated, such aperture 36 will be sized such that the golf ball 59 may not exit the basket therethrough.

As described, the flaps are substantially rigid to support the weight of a golf ball and thereby retain the golf ball within the basket, yet substantially pliable to allow deflection thereof when a ball is to be retrieved through the aperture 34 bounded by the flaps 35. Moreover, the flaps preferably are constructed such that once a ball to be retrieved through the aperture is securely in the basket 30, the flaps return to their normal position, while making an audible indication that the ball has been retrieved. Specifically, the disengagement of the flaps from the ball preferably results in a popping, snapping or other audible sound. This sound may be created by the deflection of the flaps or surrounding parts as the ball passes through the aperture 34, and the subsequent return to the original shape of the material once the ball is captured in the cup.

The entire basket 30, i.e., the sidewall 31 and the bottom 33 may be formed of a unitary structure having the same composition. Alternatively, the sidewall 31 may be formed of a more rigid material and the bottom 33 consisting of a more flexible material, for example, to aid in deformation of the flaps 35 comprising the bottom 33. Alternatively, the flaps 35 may consist of less than the entire bottom 33 of the basket, and accordingly the flaps 35 may be of a different material than the remainder of the bottom 33. Typical materials for the basket 30 may include various plastics, metal, wood, and composite materials, or the like.

Figure 2:
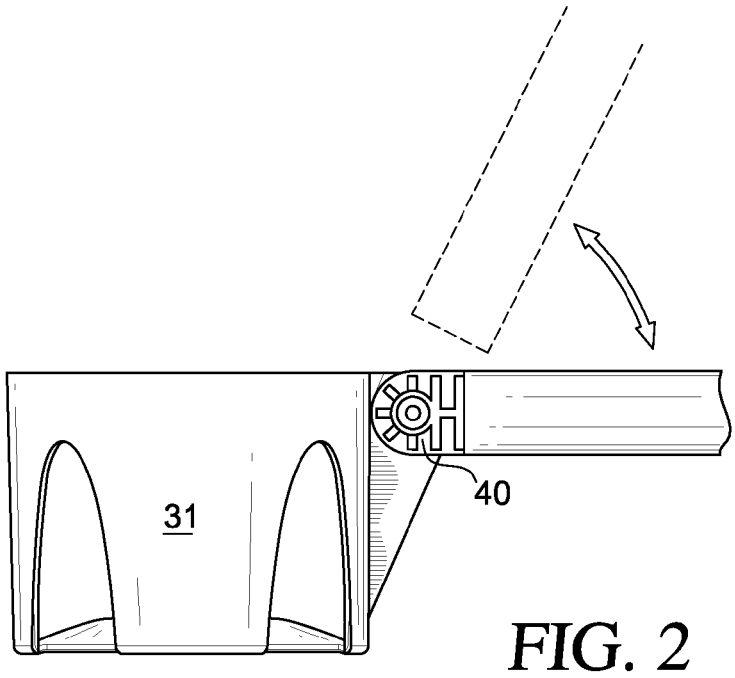
FIG. 2 is a side elevation view of the golf ball retriever illustrated in FIG. 1.
Figure 5:
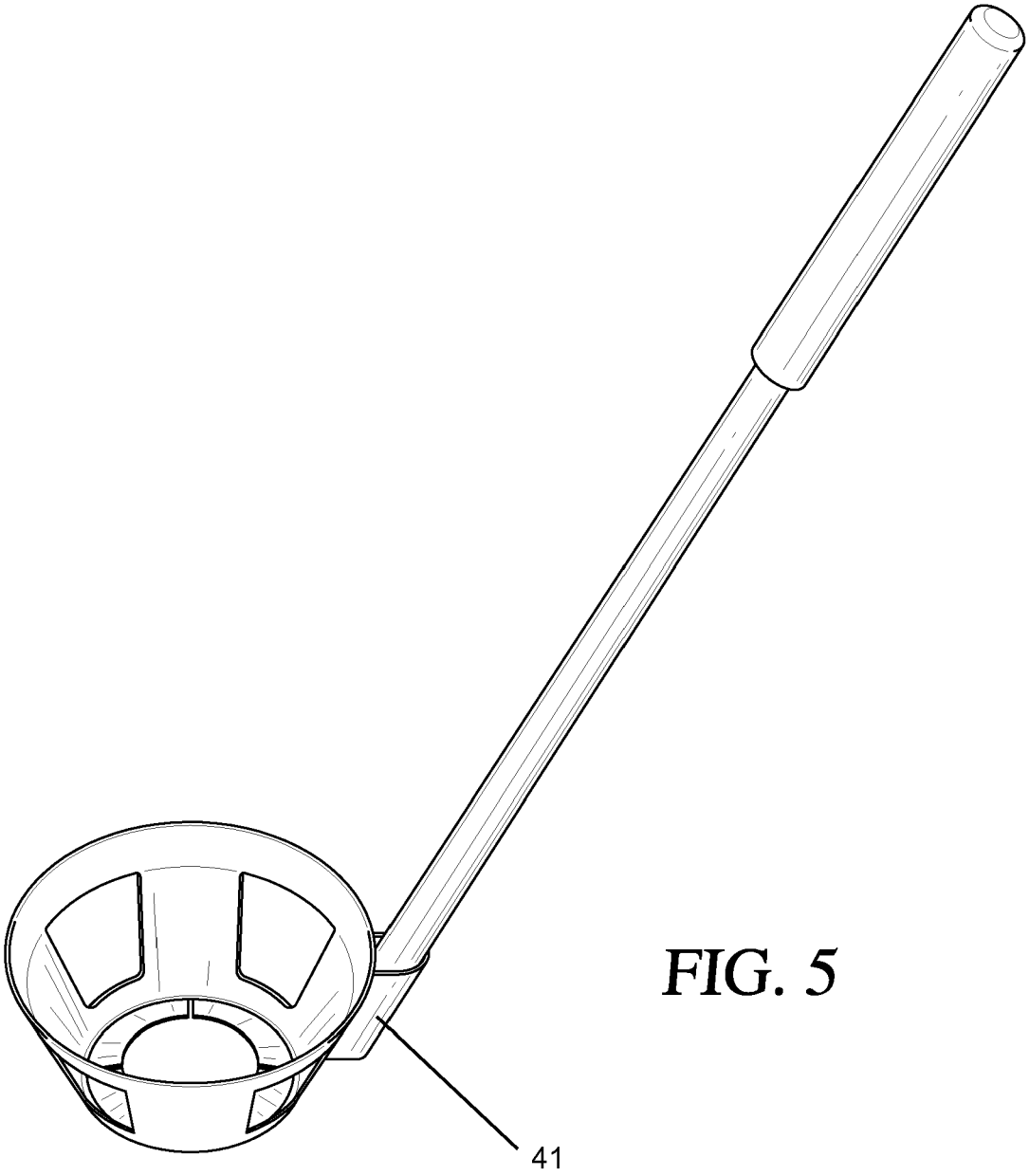
FIG. 5 is a perspective view of a golf ball retriever according to another preferred embodiment of the invention.

The sidewall 31 of the basket may be substantially cylindrical as illustrated, for example, in FIGS. 1 and 2, or the sidewall 31 may be tapered, such that the open top 32 of the basket is larger in diameter than the bottom 33 of the basket as shown, for example, in FIG. 5. Such a tapered structure may also facilitate scooping up the ball. The opening need not be circular. For example, the opening may be polygonal when viewed from above, or may be partially linear and partially curved, with the sidewall being similarly shaped.

As shown in FIG. 5, the arm 20 may be rigidly fixed to the basket 30 using the attachment mechanism 40. In this example, the attachment mechanism 40 generally includes a sleeve 41 formed on the basket 30 sized for receiving the distal end of the arm 20. Those of ordinary skill in the art will appreciate that many mechanisms are known for making a rigid attachment. For example, the sleeve 41 may be sized to create an interference fit with the distal end of the arm 20. Alternatively, detents, pins, rivets, or the like may be used to maintain the arm 20 and the sleeve 41 in fixed connection.

However, in the preferred embodiment of the invention, as illustrated in FIGS. 1-4, the attachment mechanism 40 preferably is a hinge connection 44. Such hinge configurations generally are known in the art and allow movement of the handle relative to the basket, e.g., for a varied range of positions to suit the user's preference. Other known attachment mechanisms that allow movement of the arm relative to the basket also may be used. Such mechanisms can include, but are not limited to, ball and socket arrangements, ratcheting connections, and the like.

Figure 6A:
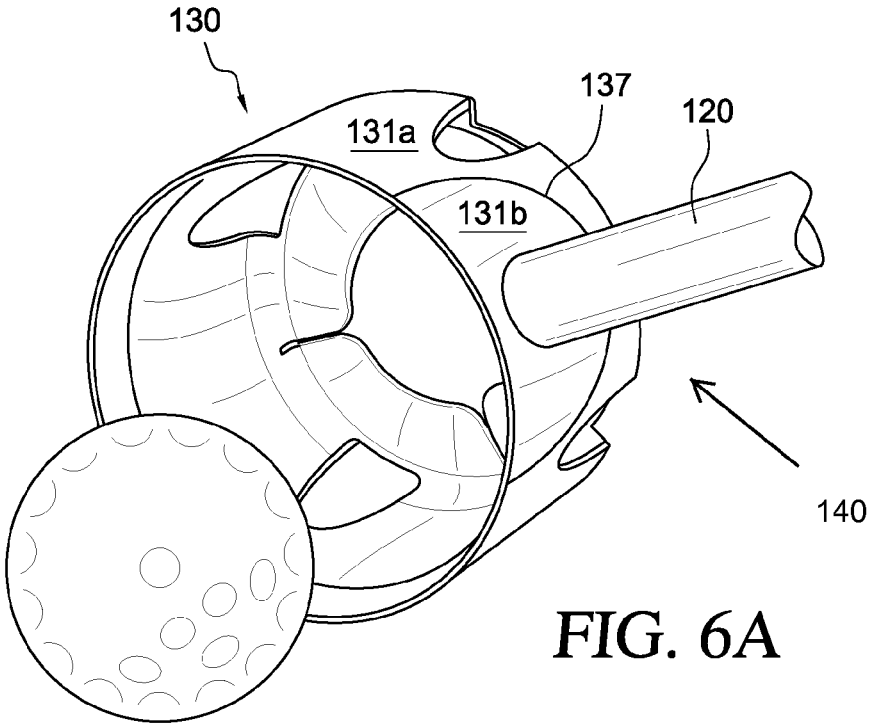
FIGS. 6A and 6B are perspective views of a golf ball retriever according to another preferred embodiment of the invention, each illustrating a method of retrieving a golf ball according to the invention.
Figure 6B:
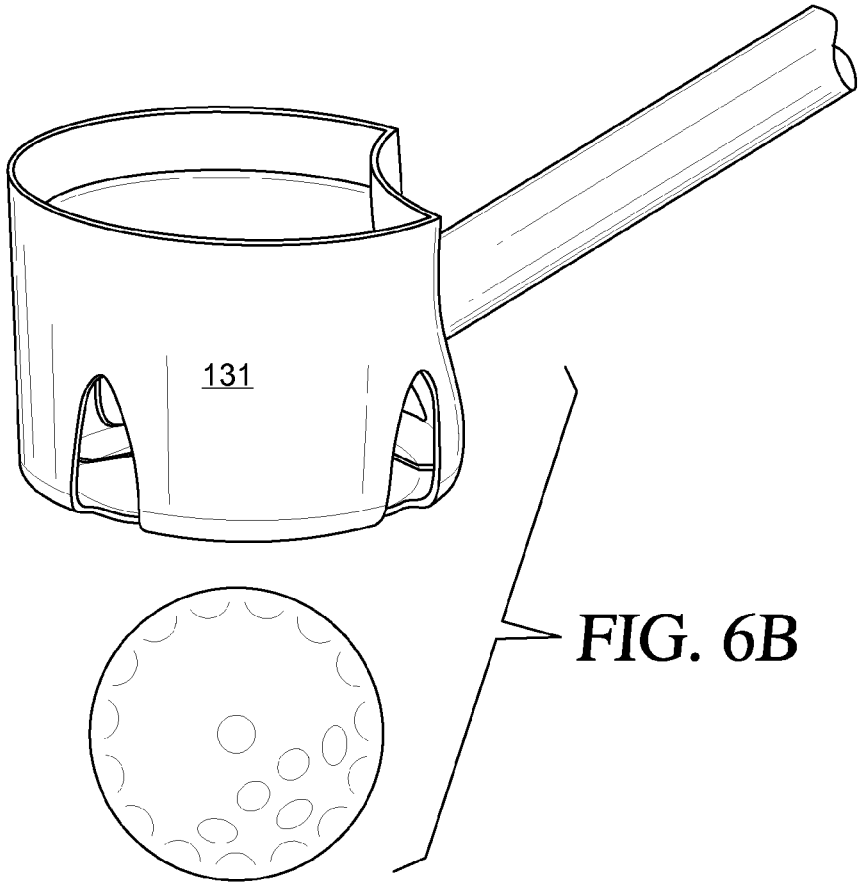

FIGS. 6A and 6B show another preferred attachment mechanism 140. As illustrated therein, the arm 20 preferably is fixed to the generally cylindrical sidewall 131 of the basket 130 such that the arm 20 is substantially perpendicular to (i.e., extends radially outwardly from) the generally cylindrical sidewall 131. (Of course, if the sidewall is generally conical, for example, the arm may not extend generally perpendicular to the sidewall, but may still preferably extend generally horizontal when the ball retriever is placed on its bottom.) A joint 137 is formed in the sidewall 131 proximate to the arm 120. The joint 137 preferably is a score mark formed in the sidewall to form a flexible portion 131*b* of the sidewall 131 immediately surrounding the distal end of the arm 120 and a rigid section 131*a*. The score mark preferably is substantially parabolic in shape. The joint serves to weaken the sidewall 131, such that when the user applies a sufficient force to the grip 22 of the arm 20, the flexible portion 131*b* of the sidewall 131 deflects inwardly, relative to the rigid portion 131*a*, resulting in an angular displacement of the arm 20 relative to its normal, generally perpendicular position. This deflection allows the arm to form an angle with respect to the bottom of the cup, and thus the user may apply a downward force to the basket 130 to effectively retrieve a golf ball through the aperture 34 formed in the bottom 33 of the basket 30, as described in more detail above.

A similar hinging arrangement may be provided without the score mark. For example, by choosing a highly flexible material for the sidewall, the basket may naturally hinge when sufficient force is applied by a user. For example, if the sidewall is sufficiently flexible, the sidewall proximate the arm will collapse or deform to allow the arm to become inclined relative to the basket.

An area of the sidewall proximate the bottom may also be angled. This angled surface may provide added stability to the retriever when being used to retrieve balls through the aperture. More specifically, a user would set the bottom of the basket on the golf ball, with the angled surface contacting the ground, to stabilize the basket while the sidewall is deflecting to angle the arm and allow the user to apply a downward force, to "pop" the ball through the aperture.

Another preferred embodiment of the invention is illustrated in FIGS. 7A-8B. Specifically, a preferred golf ball retriever 210 includes an arm 220 attached to a basket 230 having a generally cylindrical sidewall 231, similar to the embodiments described above.

An aperture 234, similar to that shown in the preceding figures, is provided through the bottom 233 of the basket. More specifically, the aperture 234 preferably has a generally round shape and a diameter smaller than the diameter of a golf ball to be retrieved. The bottom further includes one or more flaps 235, the flaps being deformable with sufficient force to allow passing of a golf ball therethrough, as described above. The flaps may be angled upwardly to further promote entrance of the ball into the basket through the aperture 234 formed in the bottom of the basket 230.

In this embodiment, however, a bottom 233 of the basket 230 preferably is angled relative to the sidewall 231. Put another way, the open top of the basket 230 is in a first plane that is nonparallel with respect to a bottom plane. The aperture 234 in the bottom of the basket preferably is in the bottom plane. The planes preferably are arranged such that the sidewall has its greatest height, i.e., distance between top and bottom, proximate the arm and its shortest height at a distance farthest from the arm. When the sidewall is cylindrical, the central axis of the circular open top will be nonparallel to the central axis of the aperture.

The bottom 233 of the basket 230 also may have a generally curvilinear or concave shape. This shape aids in guiding the ball to the center of the bottom of the basket for easier retrieval of the golf ball through the bottom. As will be appreciated, when the bottom of the basket is concave or curvilinear, the aperture 234 may not lie in a single plane. In these embodiments, the bottom plane preferably is perpendicular to a central axis of the aperture, with the bottom plane preferably nonparallel with respect to the first plane in which the open top of the basket lies.

In the embodiment illustrated in FIGS. 7A-8B, the arm is fixed relative to the sidewall of the basket. Preferably, the arm extends substantially perpendicular from the sidewall, i.e., radially outwardly from an axis of the cylindrical sidewall or parallel to the first plane described above. In this manner, a user can easily scoop a ball into the retriever through the open top, which is aligned perpendicularly with the arm. The embodiment of FIGS. 7A-8B also promotes easier retrieval of the ball through the bottom 233 of the basket 230. More specifically, because the bottom of the basket is angled relative to the arm, the arm is arranged at an angle above a horizontal plane coinciding with the ground when the angled bottom 233 of the basket 230 is placed on the ground. Angled in this manner, a user can comfortably apply a substantially vertical downward force on the retriever to force the ball through the deformable bottom 233 of the basket 230, thereby retaining the golf ball in the basket 230. The user need not bend over or awkwardly cock their wrist or elbow to pop the ball through the bottom of the basket. The arm may alternatively be moveable relative to the basket 230, for example, using any of the methods described above.

Figure 7A:
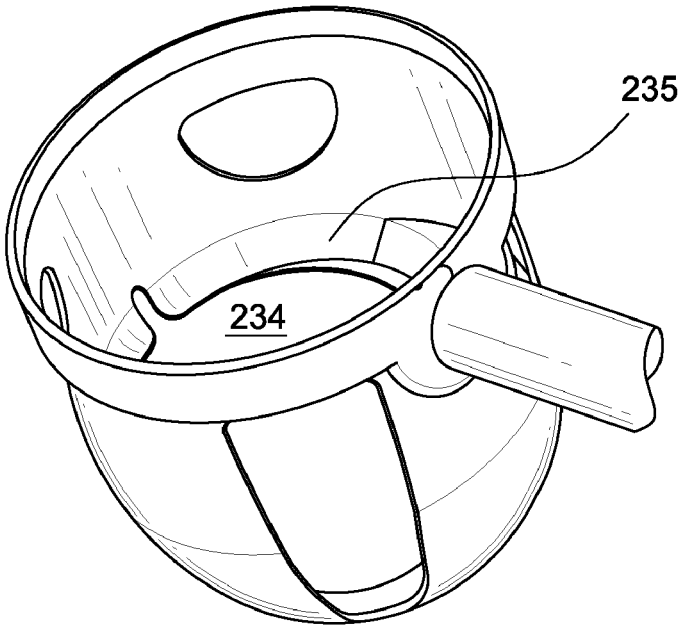
FIGS. 7A and 7B are a perspective view and a side view, respectively, of a golf ball retriever according to another preferred embodiment of the invention.
Figure 7B:
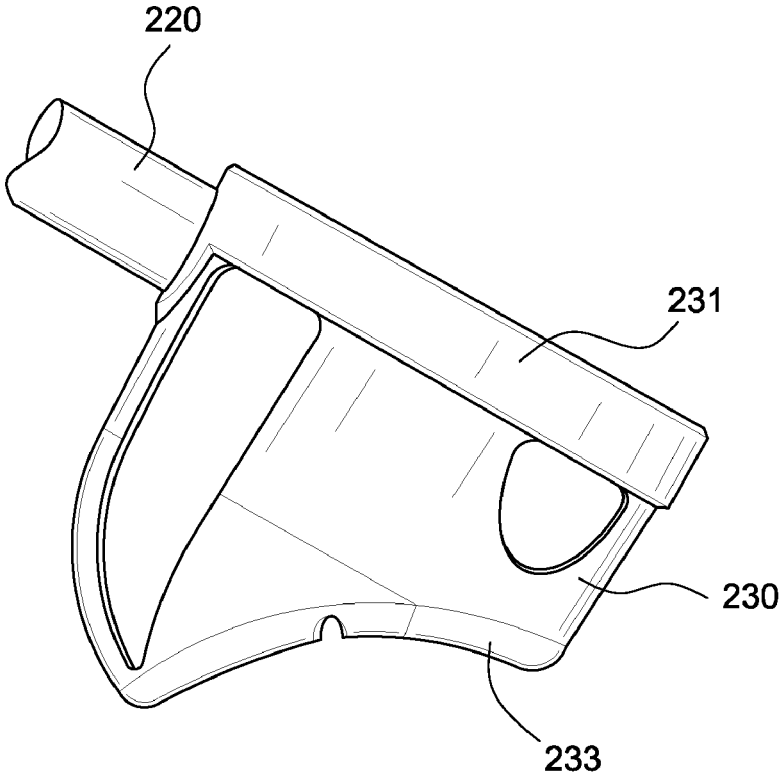
Figure 8A:
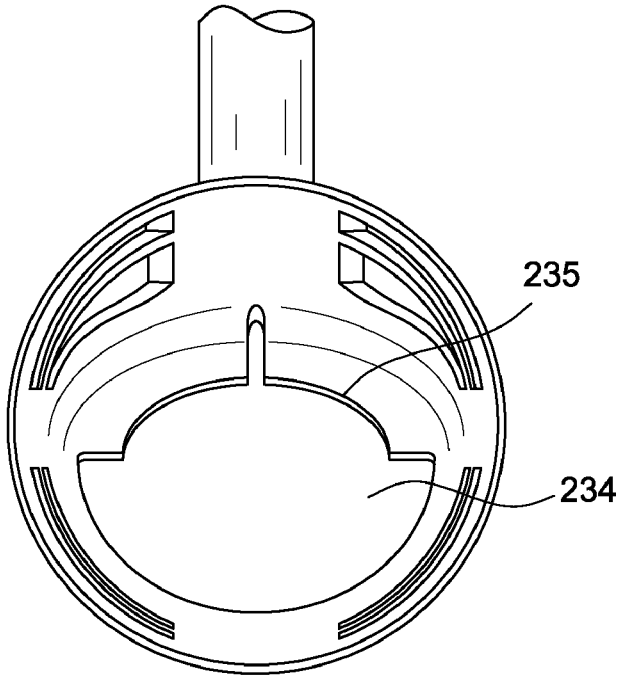
FIGS. 8A and 8B are a top view and a side view, respectively, of a golf ball retriever according to another preferred embodiment of the invention.
Figure 8B:
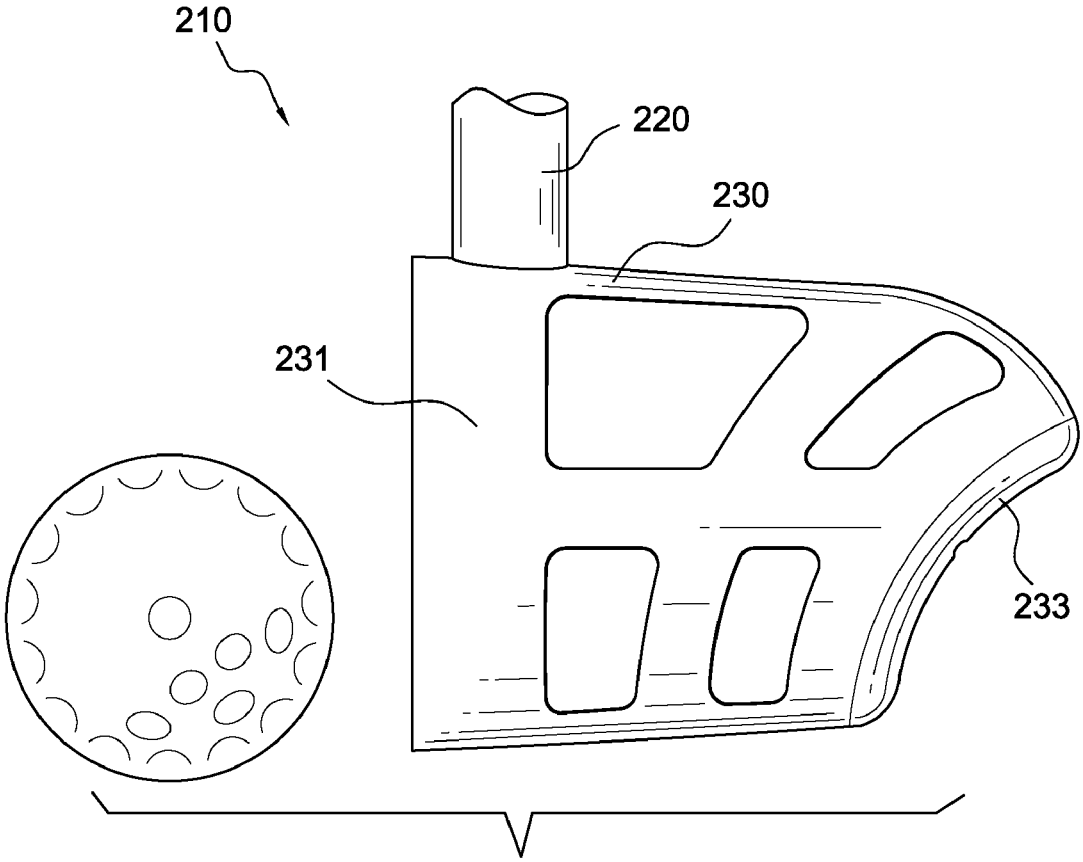
Figure 9A:
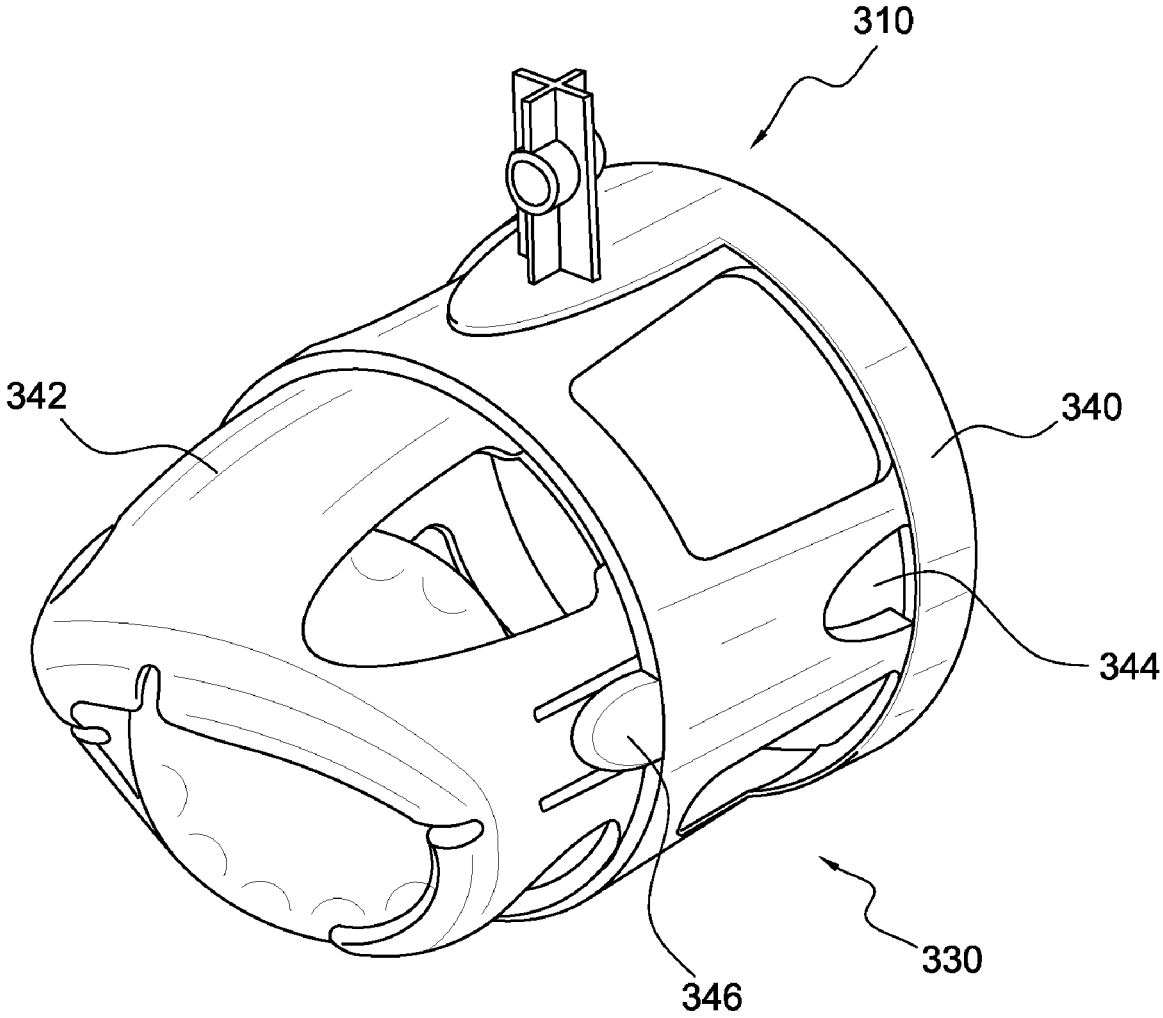
FIGS. 9A and 9B are a perspective view and a side view, respectively, of a golf ball retriever according to another preferred embodiment of the invention.
Figure 9B:
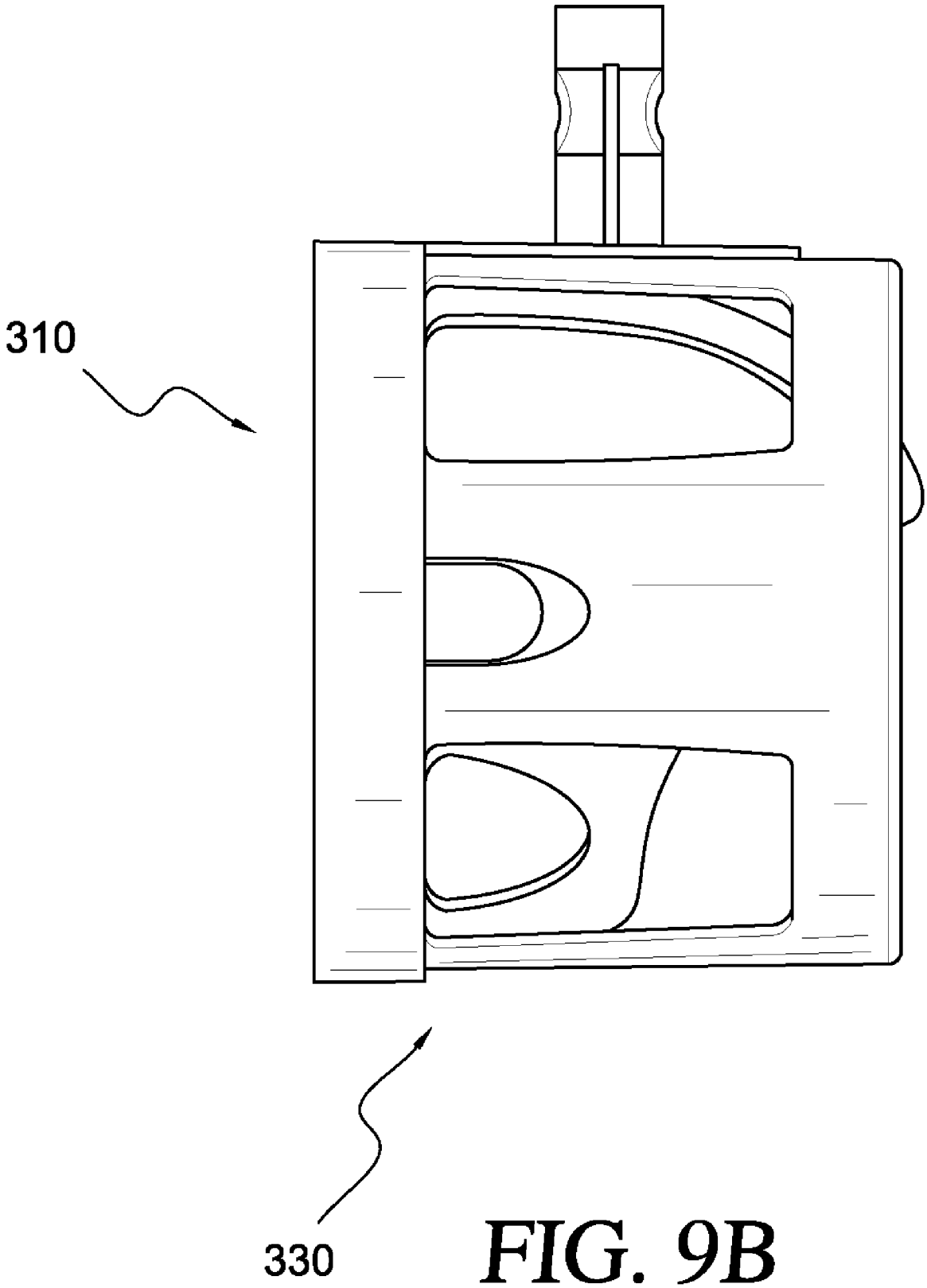

In the embodiment illustrated in FIGS. 7A and 7B, the basket is generally sized to retain one ball therein. However, FIGS. 8A and 8B show another similar embodiment in which the basket is deeper, i.e., to accommodate additional balls Another preferred golf ball retriever 310 according to an embodiment of the invention is illustrated in FIGS. 9A and 9B. This embodiment is similar to that shown in FIGS. 8A and 8B, with the exception that a basket 330 of the golf ball retriever 310 is telescopic, for example, to facilitate retrieval of more than one ball. As illustrated, the basket 330 is a two-piece construction including a stationary portion 340 and a moveable portion 342. Both the stationary portion and the moveable portion have generally cylindrical sidewalls, with an outer diameter of the moveable portion being smaller than an inner diameter of the stationary portion, such that the moveable portion can be maintained substantially inside the stationary portion when the basket is in a storing, or non-extended position. In this manner, the stationary portion acts as a sleeve in which the moveable portion is moveable.

One or more apertures 344 are provided in the stationary portion 340 for cooperatively receiving one or more tabs or flanges 346 of the moveable portion 342. The tabs 346 selectively engage the apertures 344 to maintain the moveable portion in the storing position, and when the tabs 346 are moved relatively closer to each other, the moveable portion of the golf ball retriever is moveable relative to the stationary portion to place the basket in a second, extended position. The basket 330 may be maintained in this extended position by providing additional apertures spaced relatively lower on the basket 330 into which the tabs 346 also are receivable. Alternatively, the tabs 346 may be located outside of the stationary portion of the basket, and contact a rim of the stationary portion of the basket, as generally illustrated in FIG. 9B.

Other configurations allowing for telescoping of a two or more piece basket are contemplated. For example, cooperating balls, or protrusions, and detents may be formed respectively on the stationary and moveable portions of the basket 330. Preferably, when the basket is in the extended position, the moveable portion of the basket is sufficiently rigid to allow a user to apply a downward force to the basket and enable a ball to enter the basket through a bottom of the moveable portion. This bottom is substantially identical to the bottom shown in previous embodiments. As one will appreciate, if the moveable portion is not substantially rigidly maintained in the extruded position, downward pressure on the extended basket will force the basket back into the untelescoped or storing position.

Also in these embodiments, additional apertures may be formed through the sidewall, to allow for draining of water, debris and the like from the basket when the ball is retrieved.

The basket 310 preferably also includes features for maintaining proper orientation and movement of the moveable portion with respect to the stationary portion. In one embodiment, grooves and mating protrusions are provided on the moveable and stationary portions, the protrusions sliding in the grooves when the basket is moved from the storing position to the extended position. The protrusions preferably also maintain a connection between the moveable portion and the stationary portion, i.e., so the moveable portion does not become disconnected from the stationary portion. When the slot and protrusions are not provided, the moveable and stationary portion may include cooperating flanges and shoulders to maintain this connection between the moveable and stationary portions.

Accordingly, the present invention provides a golf ball retriever capable of retrieving golf balls in one of two ways, namely, through the open top of a basket or through an aperture formed in the bottom of the basket. These methods may be employed while standing or while sitting, e.g., in a cart.

FIGS. 6A and 6B illustrate these two ways for retrieving the golf balls may be retrieved. In FIG. 6A, a golf ball is scooped up through the open top 33 of the golf ball retriever 10. In this configuration, the arm 20 is substantially perpendicular to the generally cylindrical sidewall 31 of the golf ball retriever 10. In FIG. 6B, the ball retriever 10 is used to retrieve a golf ball 59 through the aperture 34 formed in the bottom of the basket 30. In this configuration, the user hinges the arm relative to the basket by causing the smaller portion 131*a* of the sidewall 131 of the cup 130 to deflect, as described above. This deflection allows a downward force to be more readily applied to the basket relative to the ball, to retrieve the ball through the aperture formed in the bottom of the basket.

The invention is particularly well-suited for scramble golf tournaments, which require frequent ball retrieval in both a standing position and when riding in the cart. The invention also is useful for retrieving golf balls from the fairway and the rough, as well as from hazards, including water and sand. Conventional apparatuses are not well-suited to retrieve balls in more than one way and from such different lies and hazards.

The present invention has been described with reference to preferred embodiments thereof. The invention is not limited to these embodiments, as alternative configurations will be readily apparent to those of ordinary skill in the art.

We claim:

1. A ball retriever comprising:

a basket having a bottom, a sidewall extending from the bottom and terminating at an open top, the bottom of the basket having an aperture therethrough sized smaller than a ball to be retrieved, at least a portion of the bottom proximate the aperture being deformable to allow passage of the ball to be retrieved through the aperture when deformed and returning to the non-deformed position to retain the ball within the basket, the open top of the basket lying in a first plane and the aperture of the bottom lying in a second plane angled from the first plane; and an elongate arm having a first end attached to the basket and extending from the sidewall of the basket such that an axis of the arm is substantially parallel to the first plane, the elongate arm being immovable relative to the sidewall of the basket.

2. The ball retriever according to claim 1, wherein the sidewall of the basket is substantially cylindrical.

3. The ball retriever according to claim 2, wherein the elongate arm is disposed perpendicular to the sidewall of the basket.

4. The ball retriever according to claim 1, wherein the sidewall is scored proximate the attachment point of the arm.

5. The ball retriever according to claim 1, wherein the sidewall of the basket is collapsible proximate the arm.

6. The ball retriever according to claim 1, wherein the bottom of the basket is concave.

7. The ball retriever according to claim 1, wherein the basket comprises a stationary portion including one of the top and the bottom and a movable portion including the other of the top and the bottom and being movable with respect to the stationary portion to selectively vary the distance between the top and the bottom of the basket.

8. A golf ball retriever comprising:

an elongate arm;

a basket comprising a sidewall to which a distal end of the elongate arm is fixed and immovable with respect to, the sidewall terminating at an open top, and the basket further comprising one or more flaps arranged at a bottom of the sidewall, the flaps defining an opening smaller than a golf ball and being deformable to increase a size of the opening larger than a golf ball to allow passage of the golf ball through the opening when deformed and returning to the non-deformed position to retain the ball within the basket, the flaps being arranged in a second plane angled relative to a first plane in which the open top is arranged, wherein the elongate arm is fixed to the sidewall such that an axis of the elongate arm is substantially parallel to the first plane.

9. The golf ball retriever of claim 8, wherein the flaps are biased to return to the position at which the opening is smaller than a golf ball.

10. The golf ball retriever according to claim 8, wherein the height of the sidewall is greatest proximate the elongate arm and is least at a position that is substantially farthest from the elongate arm.

11. The golf ball retriever according to claim 8, wherein the elongate arm is disposed on the basket such that a longitudinal axis of the elongate arm is nonparallel to a plane in which the opening at the bottom of the basket lies.

* * * * *